United States Patent [19]

Deconinck et al.

[11] Patent Number: 4,817,677

[45] Date of Patent: Apr. 4, 1989

[54] METHOD FOR CONTROLLING THE WARP LET-OFF AND CLOTH TAKE-UP ON WEAVING MACHINES

[75] Inventors: Filip Deconinck, Zwevegem; Johan Cappelaere, Poperinge; Michel Vandeweghe, Wijtschate-Heuvelland, all of Belgium

[73] Assignee: Picanol N.V., Ieper, Belgium

[21] Appl. No.: 87,824

[22] Filed: Aug. 21, 1987

[30] Foreign Application Priority Data

Aug. 22, 1986 [BE] Belgium ..... PV2/61037

[51] Int. Cl.[4] ..... D03D 49/06

[52] U.S. Cl. ..... 139/99; 139/110; 139/309; 139/311

[58] Field of Search ..... 139/309, 100, 99, 97, 139/105, 109, 110, 304; 66/210, 203

[56] References Cited

U.S. PATENT DOCUMENTS

| | | | |
|---|---|---|---|
| 3,802,467 | 4/1974 | Steverlynck . | |
| 3,878,872 | 4/1975 | Hintsch | 139/99 |
| 4,430,870 | 2/1984 | Winter et al. | 66/210 |
| 4,605,044 | 8/1986 | Sakano | 139/99 |
| 4,619,294 | 10/1986 | Sainen et al. | 139/99 |

FOREIGN PATENT DOCUMENTS 768521 6/1971 Belgium .

*Primary Examiner*—Henry S. Jaudon
*Attorney, Agent, or Firm*—Bacon & Thomas

[57] ABSTRACT

Method for controlling the warp let-off on weaving machines, with the characteristic that the method consists of: detecting the variation with time of at least one of the parameters which are a function of the warp tension and speed of motion of the warp threads; taking the detected signal and removing the effects due to variations in the weave pattern; and using the resulting cleaned signal to control at least one warp drive motor.

17 Claims, 3 Drawing Sheets

5
4
11
7
8A
3
6
16A
13B
14B
8
12A
10
12B
15B
2
13A
8B
14A
9
1
16B
15A v f
f'
f''
f(m)

v f
f'
f''
f(m)

METHOD FOR CONTROLLING THE WARP LET-OFF AND CLOTH TAKE-UP ON WEAVING MACHINES

BACKGROUND OF THE INVENTION

This invention concerns a method for controlling the warp let-off and cloth take-up motions on weaving machines, and in particular a method of processing the associated control signals so that they are not affected by the weaving pattern.

As is well known, textile quality depends to a large extent on the tension and speed of motion of the warp threads during weaving. The speed of the warp threads depends on the speed of motion of the cloth, which in turn depends on the operating speed of the weaving machine. As explained in the Belgian patent publication No. 768,521, the difference between the speed of the warp threads and the cloth respectively is dependent on the interweaving. Normally, all measures are taken to control the warp thread speed so that the tension in the warp threads is kept as close to a constant as possible. In BE No. 768,521, the instantaneous tension is measured and used to control the warp let-off. Likewise, in BE No. 768,521, the instantaneous speed of the weaving machine drive motor is measured and used to control the warp let-off.

Also in BE No. 768,521, the speed of the cloth take-up is directly determined from the speed of the main drive motor.

However, this method of operation has the disadvantage that the control system reacts to all disturbance signals, even though compensation is not necessary for disturbance signals of very short duration since these tend to be self-compensating. If a compensation function is nevertheless generated, there is a risk of overcompensation, with all the attendant disadvantages for the quality of the textile. The primary disturbance signals for which the control system does not need to provide compensation are the periodic variations in warp tension and machine speed caused by the weaving pattern.

The object of this invention is to provide a method for systematically avoiding these disadvantages. The method used in this invention primarily consists of: detecting the variation with respect to time of one or more of the operative parameters which are functionally related to the warp tension and/or warp speed; taking the signal thus obtained and removing those components of the signal which are due to variations in the weaving pattern and; using the resulting clean signal to control the warp let-off and/or cloth take-up.

Since the variations caused by the weaving pattern are always periodic, it is better not to feed them through to the warp drive, warp let-off or cloth take-up if the abovementioned disadvantages are to be avoided.

There are various processes by which the method of the invention can be applied, either by filtering out a number of disturbance signals or by processing the signal in one or more stages in order to provide a value which is representative of the signal over a duration equal to the period necessary for the formation of a complete weave pattern or a multiple thereof. Suitable processes include integration or determining the average of the signal over the relevant period.

In order to explain the characteristics of the invention, the following preferred embodiments are described, by way of example only and without being limiting in any way, where:

Figure 1:
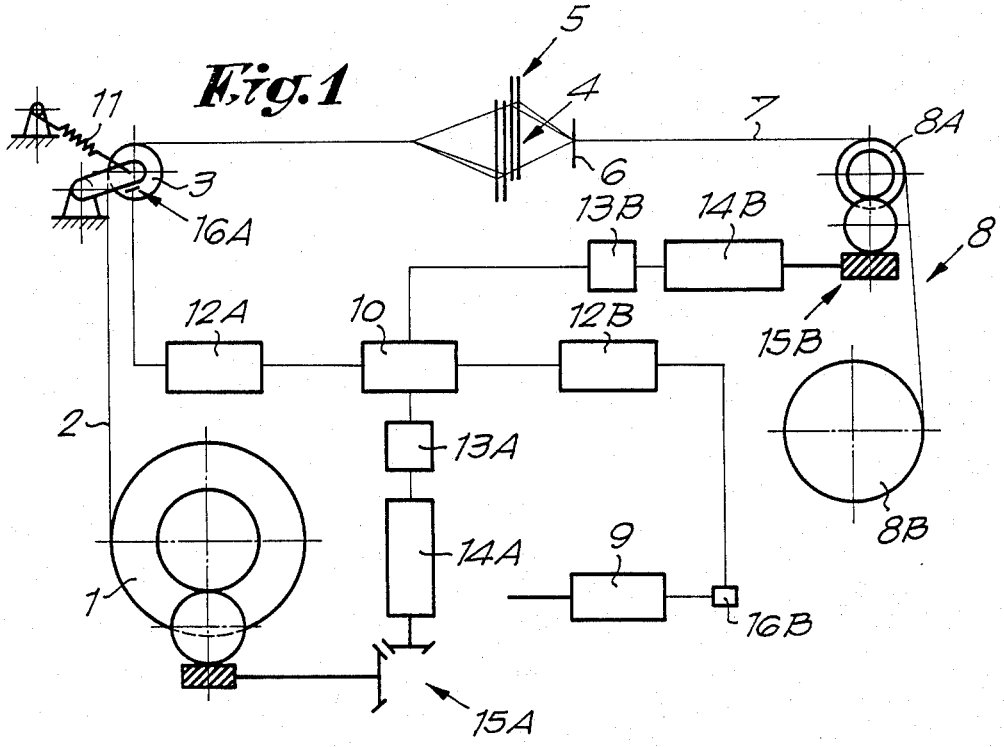
FIG. 1 is a schematic representation of the weaving process.

FIG. 1 is a schematic representation of the most important components involved in the weaving process, i.e., the warp beam 1, the warp threads 2, the warp tensioner 3, the shed 4, the frames 5, the reed 6, the cloth or textile 7, the cloth or textile take-up 8 with the breast beam 8A and the cloth beam 8B, and the weaving machine main drive motor 9. The warp let-off is controlled by a control unit 10, using the tension in the warp threads and/or the speed of the weaving machine 2 to adjust the amount of warp let-off.

The warp tension can be determined in a conventional manner, for example by detecting the displacement of the warp tensioner 3 as it presses in towards the elastic restraint 11, while the weaving machine speed can be measured directly on the main drive motor 9.

One or both of the detected signals representative of the warp tension are then fed via the appropriate regulator (12A or 12B respectively) to e.g., control unit 10. Control unit 10 then supplies a signal to controller 13A, which controls warp let-off motor 14A. This signal is a function of the detected warp tension and machine speed. Motor 14A is coupled to warp beam 1 by an appropriate transmission 15A.

In a similar way, a signal from control unit 10 is supplied to controller 13B of a cloth take-up motor 14B; however in this case the signal should preferably be a function of the detected machine speed only.

Controllers 13A and 13B should preferably be frequency controllers.

In FIG. 1, the warp tension and machine speed detectors are indicated in a general manner only, by 16A and 16B respectively. For example, 16B can be a tachogenerator; or it can be a current meter which measures the current supplied to the motor, as this is representative of the motor speed.

In the methods previously used, all types of disturbance signal, including periodic disturbances, are passed to regulators 12A and 12B in order to regulate the speed of motors 14A and 14B respectively.

In this invention however, periodic disturbances which are liable to cause overcompensation in warp let-off motor 14A and/or cloth take-up motor 14B are ignored, in particular the disturbance signals due to the weaving pattern are ignored. Here it should be noted that since the warp extension caused by the upper frames differs from that caused by the lower frames, and since there is a difference in the warp extension caused by the front and rear frames, the period of these periodic disturbance signals corresponds to the time necessary to form a complete weave pattern. Similarly, due to the difference in motion of the frames, the power drawn from the main drive motor 9 also varies periodically according to the weave pattern, and so also does the machine speed. These operative parameters can be used in the method of the invention, for example by means of the following embodiments to be discussed.

In the first embodiment of the method of the invention, the predetermined effects of variations in warp tension and machine speed due to the weave pattern are suppressed by taking the signal representing the warp tension or machine speed and filtering out all disturbance components from the signal with a frequency equal to the predetermined frequency of the variations caused by the weave pattern or a multiple thereof. This can be done by means of suitable regulators 12A and 12B, each comprising an electric filter that selectively reduces the predetermined frequency of the disturbance components due solely to the variations in warp tension and machine speed resulting from the particular weave pattern of the cloth. The use of electric filters to enhance or reduce specific frequency components of a signal is known and is not further explained here. The resulting filtered signal is composed of frequency components representing the variations in warp tension and/or machine speed due to factors other than the particular weave pattern. The signal is then passed in the conventional manner to controllers 13A and 13B of motors 14A and 14B. Controllers 13A and 13B can of course be of any type, for instance frequency controllers if the motors are frequency-regulated.

Figure 2:
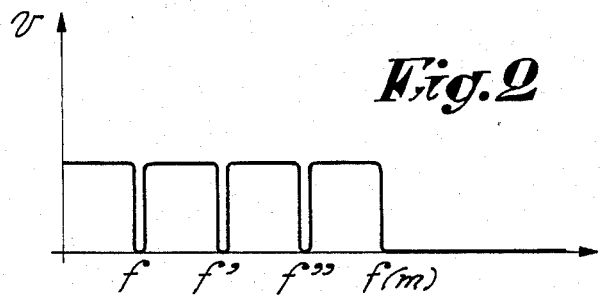
FIGS. 2 and 3 represent the filter functions obtained in one embodiment of the invention.

The process just described is illustrated by the frequency characteristic shown in FIG. 2. The frequency F of the warp tension variations due to the weave pattern can be calculated beforehand from the weave pattern and the known machine speed, since F is equal to the quotient of the frequency of the machine speed F(m) and the number of machine cycles necessary to form one complete weave pattern. In the example shown in FIG. 2, one complete weave pattern is formed in four machine cycles, therefore F is $\frac{1}{4}$ of F(m). Accordingly, regulators 12A and 12B with their filters are used to filter out all input signals with frequency F, also frequency $F'=2F$, $F''=3F$, etc. by applying an amplification factor v equal to O.

The filtered signal is then sent to control unit 10, in order to command frequency controllers 13A and 13B of motors 14A and 14B.

In a second embodiment, in addition to the filtering just described, the signal components with a frequency greater than the frequency of the machine F(m) are eliminated by using a low pass filter as shown in FIG. 2. The low pass filter filters out the high frequency components and allows the passage of only signal frequency components below the machine frequency to the controller 13A and 13B.

Figure 3:
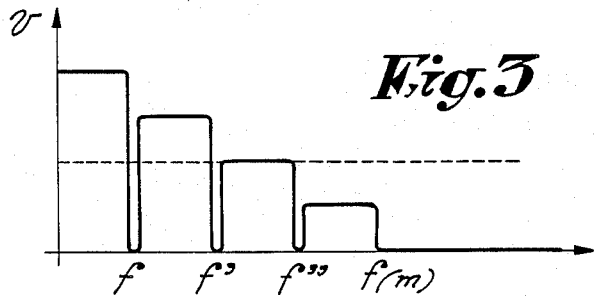

In another embodiment, in addition to being filtered, the lower frequencies are amplified more than the higher frequencies, while the highest frequencies are attenuated so as to eliminate them completely, as shown in FIG. 3. Since the lower frequencies play a greater role in determining the appearance of the cloth, this embodiment has a favorable effect on the end result.

Figure 4:
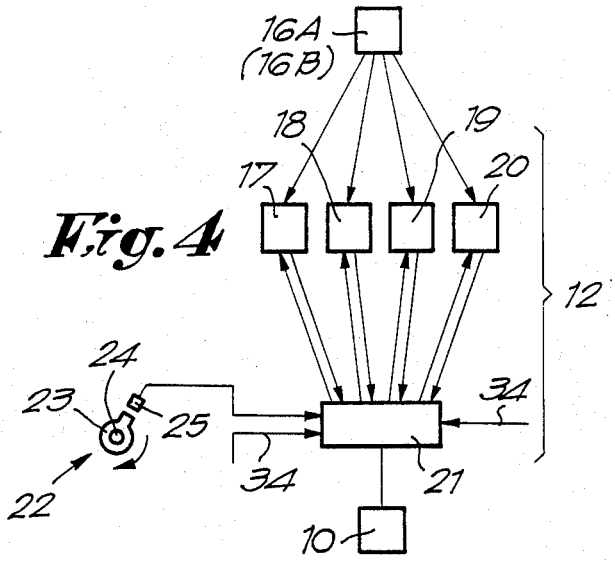
FIG. 4 is the control diagram for another embodiment.

In the embodiments described below, instead of a filter, one or more integrators are used to eliminate the variations in tension due to the weave pattern. Note that although the following embodiments are only described for the warp tension signal (detector 16A), they are also applicable to the machine speed signal (detector 16B). The control diagram for one possible embodiment is shown in FIG. 4. This embodiment uses a tension meter or detector 16A, a number of integrators (17–20), a control unit 21, a trigger 22 consisting of a cam 23 mounted on a shaft 24 (gauged to the machine speed) and a proximity switch 25, and control unit 10. Integrators 17 to 20 and control unit 21 correspond to regulator 12A used in the previous embodiments.

Figure 5:
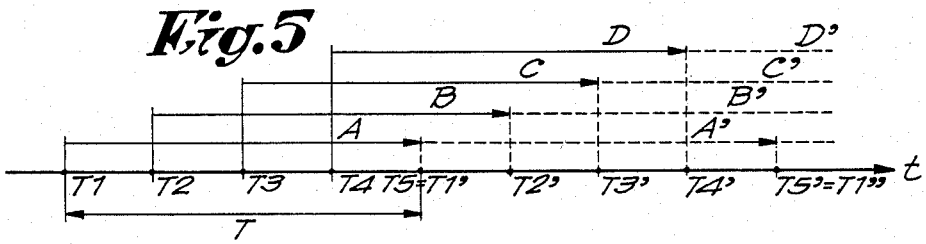
FIG. 5 represents the integration periods used for the embodiment of FIG. 4.

The operating process used to eliminate the warp tension variations caused by the weave pattern is illustrated in FIG. 5. The tension meter or detector 16A continuously measures the tension in the warp threads 2, and passes this value to integrators 17–20, which are switched on and off by trigger 22 and control unit 21. Integrator 17 is activated at time T1 and integrates the measured warp tension over a particular time period A. Similarly, integrators 18, 19 and 20 are activated at times T2, T3 and T4 and integrate the warp tension over time periods B, C and D respectively. The essential point here is that the duration of each of the time periods A, B, C and D is equal to the time period T necessary to form one complete weave pattern, or a multiple thereof, while times T1 to T4 are chosen so that all of the time periods A to D overlap each other.

The variation of the mean warp thread tension can be calculated from the known weave pattern. The integral of the measured warp tension variations obtained by the integrators is compared with the integral of the theoretically determined warp tension variations for the particular time period A, B, C or D. The warp let-off is controlled as a function of the difference in the two integrals.

Since the duration of time periods A, B, C and D is equal to or a multiple of the time T necessary to form one complete weave pattern, the integration results generated by integrators 17 to 20 at the end of periods A to D, i.e., at times T1′ to T4′ respectively, are representative of the tension in the warp threads 2, but without being influenced by the variations in warp tension caused by the weave pattern. Due to the fact that the periods A to D overlap, it is not necessary to wait until a period T has elapsed before being able to supply a measurement result to control unit 21 of warp let-off drive 25.

Each time one of the integrators 17 to 20 has carried out an integration over one of the corresponding periods A to D, the result is passed to control unit 21, the integrator is reset to zero and a new integration begins over the next period A′, B′, C′ or D′.

Trigger 22 and control unit 21 should preferably control integrators 17 to 20 in such a way that time T1 coincides with the beginning of a new weave pattern, while the subsequent times at which integrators 18 to 20 are activated are evenly distributed over the time interval T. Times T1, T2 etc. should also preferably be chosen so that they coincide with successive starts of the weaving cycles. Since the integrations are carried out over a period equal to the period necessary for forming one complete weave pattern, the integrators can be activated at any desired angular position of the weaving machine.

Figure 6:
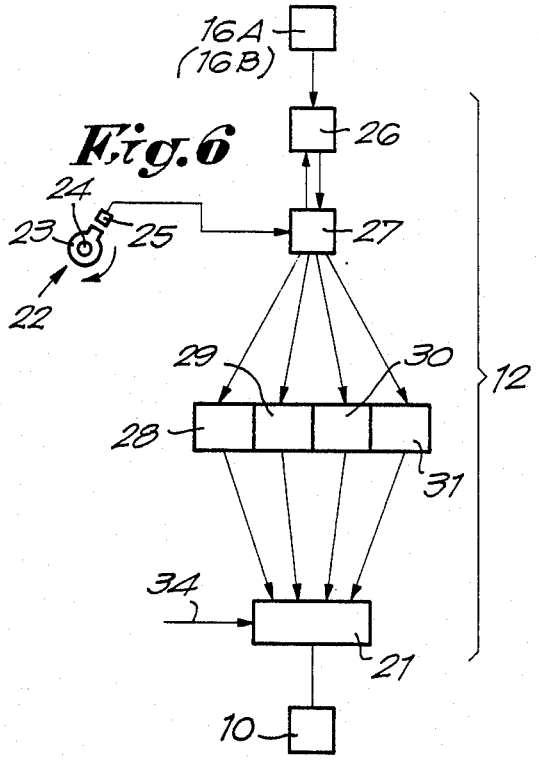
FIG. 6 is the control diagram for yet another embodiment.

As can be seen from the control diagram shown in FIG. 6, it is also possible to use just one integrator 26. Pulses from trigger 22 are used to control a distributor 27, which connects integrators 26 to a number of comparators in turn, in this case the four comparators 28 to 31. These comparators command control unit 21. Trigger 22 ensures that the integrator is reset at zero at set times, and that distributor 27 supplies the integration results to comparators 28 to 31 successively.

Figure 7:
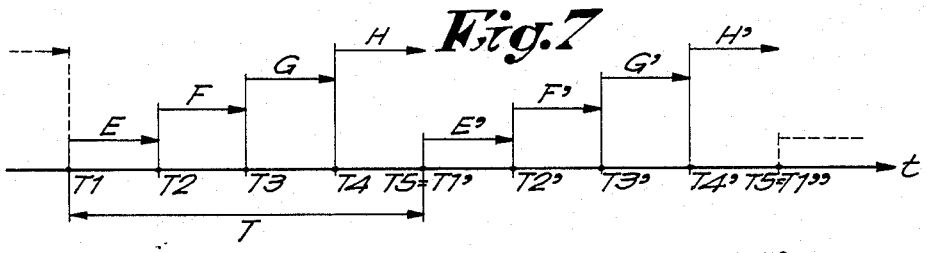
FIG. 7 represents the method of integration over time for the control diagram shown in FIG. 6.

The operating process for this embodiment is illustrated by FIG. 7. Since the weave pattern is known beforehand, the variation of tension with time can be calculated for particular time intervals, e.g., in this case for the time intervals T1 to T2, T2 to T3, etc. The four values obtained are entered in comparators 28 to 31. The tension in the warp threads 2 is then integrated separately for each of the periods E to H and then E' to H', etc. shown in FIG. 7. Then, according to the control diagram shown in FIG. 6:

at time T2 the integral of the measured variation of warp tension over the time period E is compared in comparator 28 with the precalculated variation of warp tension due to the weave pattern for time interval E;

at time T3 the integral of the measured variation of warp tension over the time period F is compared in comparator 29 with the precalculation variation of warp tension due to the weave pattern for time interval F;

etc. The warp let-off is controlled as a function of the difference between the two integral values.

Clearly, the method of the invention also fits the process just described. The duration of the integration intervals E, F, G and H should correspond to the duration of successive weaving cycles.

Figure 8:
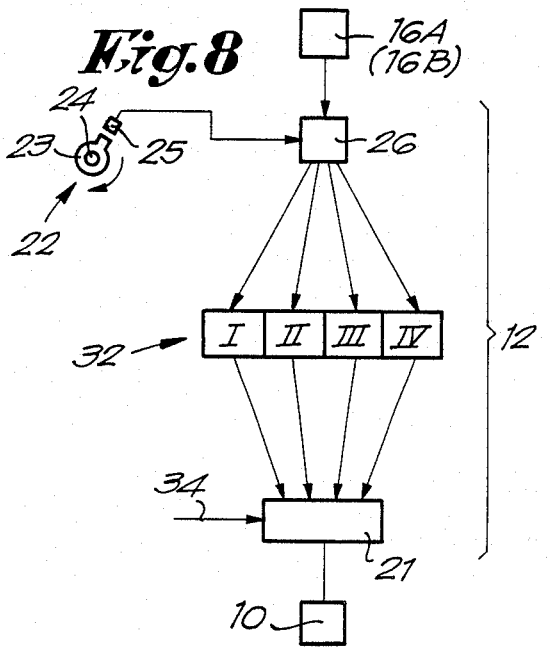
FIG. 8 shows yet another possible control diagram.
Figure 13:
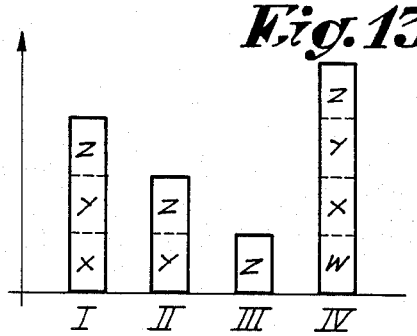

The embodiment shown in FIG. 8 also uses an integrator 26. After this integrator 26 there is a series 32 of adders, I, II, III and IV, which one after the other send signals to control unit 21.

Figure 9:
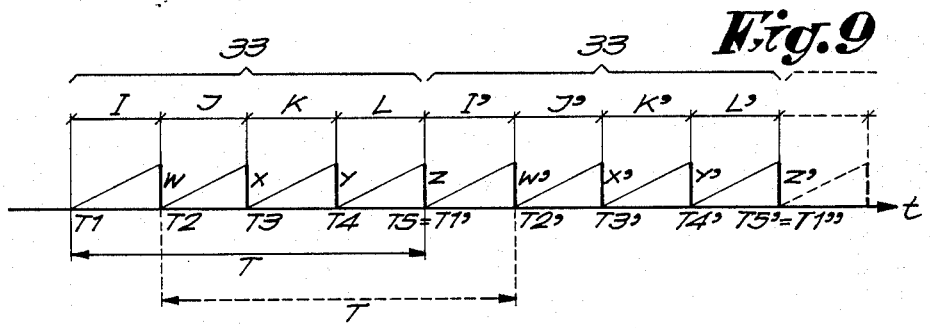
FIG. 9 shows the time sequence of the integration periods over which the integrations for the control diagram in FIG. 8 are carried out.

The operating process for this embodiment is shown in FIG. 9. Integrator 26 operates in turn over the partial periods I, J, K, L, I', J', K' and L' which form identical sequences 33, each with a total duration equal to the period T necessary to form one or more complete weave patterns. At time T2 the integration result W over the partial period I is supplied to the memory of adder I; at time T3 the integration result X over the partial period J is supplied to the memories of adders I and II; at time T4 the corresponding result Y is supplied to I, II and III; and at time T5 the result Z is supplied to the memories of all four adders.

At that moment, the memory of adder I contains the total value W+X+Y+Z, which corresponds to the integration of the warp tension over the immediately preceding period with duration equal to time T. This total value is therefore representative of the variations in tension of the warp threads 2, but without taking into account the variations in tension due to the weave pattern. Here it should be noted that the total value W+X+Y+Z is equal to the integration result obtained over the integration period A in FIG. 5.

The total value thus obtained is sent by adder I to control unit 21 in order to regulate the warp drive motor, and the adder is then reset at zero. At time T2' the value W' is added to the memory of all the adders. At that moment the memory of adder II contains the total value X+Y+Z+W', which is similarly passed to control unit 21. The operating process can then continue in the same way, with the total value in each memory being sent to control unit 21 as soon as it is equivalent to an integration of the warp tension for the period just past with duration equal to the duration of the above mentioned series 33, i.e., period T.

Figure 10:
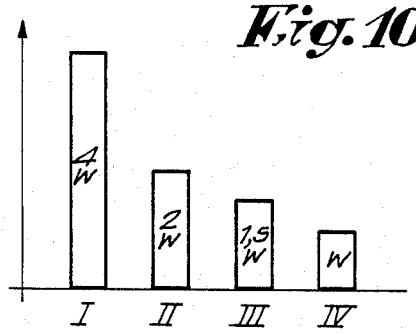
FIGS. 10 to 13 illustrate the startup sequence after a machine stop, for the control diagram shown in FIG. 8.
Figure 11:
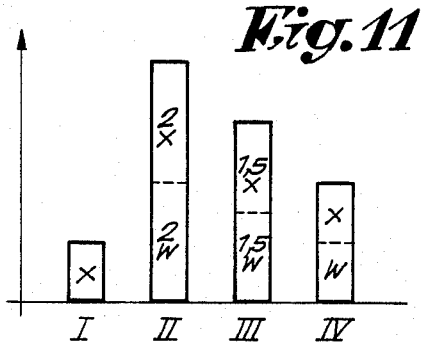

In the configurations shown in FIGS. 6 and 8, it is necessary for a period T to elapse before control signals can be sent to control unit 21. However, it is of course possible to generate intermediate values. One method of doing this for the embodiment of FIG. 8 is shown schematically in FIGS. 10 to 13. Here, during the first partial period I control is carried out on the basis of values still present in memory from the previous measurement. As soon as value W arrives at integrator 26, it is multiplied by 4.0 and added to the memory of adder I; also it is multiplied by 2.0 and added to the memory of adder II, multiplied by 1.5 and added to the memory of adder III, and finally multiplied by 1.0 and added to the memory of adder IV (FIG. 10). The value 4W from adder I is then supplied to control unit 21. During the second partial period J, adder I is reset to zero. At time T3 the value X is taken from integrator 26 and placed in the memory of adder I; also it is multiplied by 2.0 and added to the memory of adder II, multiplied by 1.5 and added to the memory of added III, and finally it is multiplied by 1.0 and added to the memory of adder IV (FIG. 11). At this point the value stored in adder II is sent to control unit 21 in order to control the warp let-off drive. Shortly thereafter, at the latest during partial period K, adder II is reset at zero.

Figure 12:
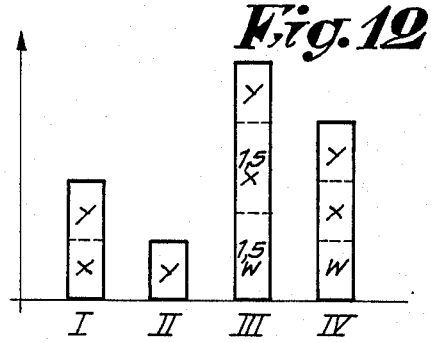

From this point on the normal operating process is followed once more; i.e., at time T4 value Y from integrator 26 is added to the memory contents of the four adders, as shown in FIG. 12. The total content of adder III is sent to control unit 21, and the adder is then reset at zero. At time T5 the value Z obtained by integration over partial period L is passed from integrator 26 to the four adders I to IV, and the sum present in the memory of adder IV is sent to control unit 21. The same procedure is followed with value W', then in the following step with value X', and so on.

As shown in FIGS. 4, 6, and 8, the signals 34 can also be sent to control unit 21, for example, after a machine stop, in order to instruct control unit 21 to follow the special start procedure.

In yet another embodiment of the invention, this time described with reference to measurement of the machine speed, the time necessary to form one complete weave pattern is measured, for example using a wheel with 36 teeth which rotates at the same speed as the main drive motor. Thus, a weave pattern for which four machine cycles are necessary will correspond to 144 teeth. The teeth are detected by a fixed detector. Each time one of the teeth passes the detector, a clock is started; it is reset at zero when 144 teeth have passed, thus measuring the time necessary for one complete weave pattern. This value is representative of the machine speed, but independent of the weave pattern, as required for the invention. This method yields 36 representative values for the machine speed. Obviously, a special startup procedure will have to be used when starting up the weaving machine.

Clearly, all the embodiments described above with reference to FIGS. 4–13 can also be applied to signals obtained by measuring the machine speed. Such signals may consist simply of the voltage supplied by the above mentioned tachogenerator.

Although the embodiments described so far all use integration, the method of the invention can also be applied by taking the average of the above mentioned intervals, in order to obtain representative values for these intervals.

The machine can then be controlled in the normal way, by means of control unit 10. Preferably, however, for the purposes of the invention the machine should be controlled as follows: the motor speed is governed at a value K multiplied by the filtered signal, where the value of K varies according to the weaving process. Where there are large variations in tension, the value of K can be automatically increased or reduced in order to achieve faster correction. The value of K can also be a function of the beam diameter or the interweaving, or can change suddenly when there is a transition from one type of textile to another, for example, a change to a different weave with a corresponding change in the period necessary to form the weave pattern.

In such a case, i.e., when there is a change in the weave, the period over which the required measurement is carried out must, of course, be modified automatically.

Clearly, for both the warp tension and/or motor speed, it is possible to measure either the variations or the absolute values.

The invention is not limited to the examples described above and the embodiments shown in the figures; on the contrary, the method for controlling the warp let-off on weaving machines can be applied according to many variants.

We claim:

1. A method of controlling the rate of warp let-off and cloth take-up in a weaving machine, said method comprising:

generating a signal that is a function of a variation over time in at least one of a plurality of parameters that are functionally related to warp thread tension and warp thread speed;

processing the generated signal by removing a component of the signal that is a function of the variation over time of the parameter due to changes in a weaving pattern; and using the processed signal to control the rate of warp thread let-off and cloth take-up in the weaving machine so that effects due to variations of the weave pattern during weaving are removed.

2. A method as claimed in claim 1 wherein the generated signal is a function of the variation in warp thread tension, and using a warp thread let-off motor to control the rate of warp thread let-off and cloth take-up in response to the generated and processed signal.

3. A method as claimed in claim 1 wherein the weaving machine includes a main drive motor and the generated signal is a function of the variation in the speed of the main drive motor, and using a warp thread let-off motor to control the rate of warp thread let-off and cloth take-up in response to the generated and processed signal.

4. A method as claimed in claim 1 wherein the weaving machine includes a main drive motor and the generated signal is a function of the variation in the speed of the main drive motor, and using a cloth take-up motor to control the rate of warp thread let-off and cloth take-up in response to the generated and processed signal.

5. A method as claimed in claim 1 wherein the processing of the generated signal includes using an electric filter for removing the component of the signal that is a function of the variation over time of the parameter due to changes in the weaving pattern by filtering out all component frequency signals from the generated signal which have a frequency equal to a predetermined frequency of the parameter variations that are due to the changes in the weave pattern.

6. A method as claimed in claim 1 wherein the processing of the generated signal includes using an electric filter for removing the component of the signal that is a function of the variation over time of the parameter due to changes in the weaving pattern by filtering out all component frequency signals from the generated signal which have a frequency equal to a multiple of a predetermined frequency of the parameter variations due to the changes in the weave pattern.

7. A method as claimed in claim 1 wherein the weaving machine includes a main drive motor and the generated signal represents the variation in the speed of the main drive motor, wherein the processing includes using an electric filter to filter out all component frequency signals from the generated signal which have a frequency greater than a predetermined frequency of the main drive motor speed variations due to the changes in the weave pattern.

8. A method as claimed in claim 1 further comprising:

using comparators during processing of the generated signal by determining a representative value for said generated signal over predefined time periods;

comparing in said comparators the representative values for each time period with a predetermined reference value calculated from the weave pattern;

using the difference of the representative value and the reference value obtained in the comparison as the processed signal used for controlling the rate of warp thread let-off and cloth take-up.

9. A method as claimed in claim 8 wherein the predefined time periods are integral divisions of the time period necessary to form a complete weave pattern.

10. A method as claimed in claim 8 including determining said representative value for said generated signal over said predefined time periods by averaging said signal over said time periods.

11. A method as claimed in claim 8 including using integrators during said processing of the generated signal and determining said representative value for said generated signal over said predefined time periods by integrating said signal over said time period.

12. A method of controlling the rate of warp let-off and cloth take-up in a weaving machine, said method comprising:

generating a series of signals during operation of the weaving machine that are representative of a function of a variation in at least one of a plurality of parameters that are functionally related to warp thread tension and warp thread speed over a time period of duration equal to a time period necessary to form a complete weave pattern including multiples thereof;

separating the signals by a time period that is an integral division of the time period necessary to form a complete weave pattern including multiples thereof;

processing the generated signals by removing a component of the signals that is a function of the variation over time of the parameter due to changes in a weaving pattern; and using the processed signals to control the rate of warp thread let-off a cloth take-up in the weaving machine so that effects due to variations of the weave pattern during weaving are removed.

13. A method as claimed in claim 12 including using integrators during said processing of the generated and processing said generated series of signals by integrating each of said signals over said time period.

14. A method as claimed in claim 12 including processing said generated series of signals by averaging each of said signals over said time period.

15. A method of controlling the rate of warp let-off and cloth take-up in a weaving machine comprising electronic adders, said method comprising:

generating a series of signals during the operation of the weaving machine, with each signal of the series being functionally related to a variation in at least one of a plurality of parameters that are functionally related to warp thread tension and warp thread speed over a partial time period of duration equal to an integral division of a time period necessary to form a complete weave pattern including multiples thereof;

processing the generated signals of the series by removing a component of the signals that is a function of the variation over time of the parameter due to changes in a weaving pattern, using a number of adders equal to the number of time period divisions, supplying each of the signals of the series to the adders and summing in the adders the supplied signals of the series with previous signals of the series supplied to the adders;

taking from each adder in turn the sum of the signals of the series supplied to the adder over a time period equal in duration to the time period necessary to form a complete weave pattern including a multiple thereof; and using said sum of the signals of the series to control the rate of warp thread let-off and cloth take-up so that effects due to variations of the weave pattern during weaving are removed.

16. A method as claimed in claim 15 including using integrators during said processing of the generated series of signals and processing said generated series of signals by integrating each of said signals over said partial time periods.

17. A method as claimed in claim 15 including processing said generated series of signals by averaging each of said signals over said partial time periods.

* * * * *